US006092451A

United States Patent [19]

Granger

[11] Patent Number: 6,092,451

[45] Date of Patent: Jul. 25, 2000

[54] AUTOMATIC OR SEMI-AUTOMATIC DISPENSING MACHINE FOR WIPE MATERIAL WITH SELECTOR DEVICE

[76] Inventor: Maurice Granger, 17 rue Marcel Pagnol, 42270 Saint Priest en Jarez, France

[21] Appl. No.: 09/051,505

[22] PCT Filed: Jul. 22, 1996

[86] PCT No.: PCT/FR96/01148

§ 371 Date: Apr. 10, 1998

§ 102(e) Date: Apr. 10, 1998

[87] PCT Pub. No.: WO97/13441

PCT Pub. Date: Apr. 17, 1997

[30] Foreign Application Priority Data

Oct. 10, 1995 [FR] France ..... 95 12108

[51] Int. Cl.[7] ..... B65H 20/26

[52] U.S. Cl. ..... 83/335; 83/337; 83/649; 83/949

[58] Field of Search ..... 83/649, 650, 335, 83/337, 648, 334, 298, 314; 225/16, 11, 10, 72

[56] References Cited

U.S. PATENT DOCUMENTS

| | | | |
|---|---|---|---|
| 2,206,979 | 7/1940 | Steiner | 225/16 |
| 3,739,965 | 6/1973 | Jespersen et al. | 83/337 |
| 4,188,844 | 2/1980 | DeLuca | 83/335 |
| 4,213,363 | 7/1980 | Granger | 83/298 |
| 4,441,392 | 4/1984 | DeLuca | 83/335 |
| 4,712,461 | 12/1987 | Rasmussen | 83/334 |
| 4,844,361 | 7/1989 | Granger | 242/55.3 |
| 5,048,386 | 9/1991 | DeLuca et al. | 225/96 |
| 5,078,033 | 1/1992 | Formon | 83/335 |

FOREIGN PATENT DOCUMENTS

| | | |
|---|---|---|
| 2332215 | 11/1975 | France . |
| 2701016 | 2/1993 | France . |

OTHER PUBLICATIONS

PCT/IPEA/409—English Translation in International Examination Report, PCT/FR96/01110 Filed Jul. 17, 1996.

*Primary Examiner*—Rinaldi I. Rada
*Assistant Examiner*—Kim Ngoc Tran
*Attorney, Agent, or Firm*—Wall Marjama Bilinski & Burr

[57] ABSTRACT

A dispensing apparatus including a device for selecting the operating mode of the apparatus so that it operates automatically or semi-automatically. The device includes a first member forming a double lever with opposed arms freely and pivotally mounted in the central portion of the device relative to a fixed point on the flange of the housing of the apparatus. The ends of the double lever are arranged to be functional depending on the operating mode of the apparatus. The device includes a second, handle-like component positioned and pivotally mounted about the pivot axis of the double lever. The handle is pivotable between two end positions counter to a resilient return mechanism enabling, depending on its position, the double lever to be positioned relative to a rotatable drum and the device to be operated in either an automatic or semi-automatic mode.

9 Claims, 6 Drawing Sheets

1
4
4a
4b
5
8
9
10
10a
10b
10c
10d
10e
10f
10g
11
12
12a
12b
12c
13
14
15
15a
15b
16
18
19
19a

AUTOMATIC OR SEMI-AUTOMATIC DISPENSING MACHINE FOR WIPE MATERIAL WITH SELECTOR DEVICE

FIELD OF THE INVENTION

The invention relates to the technical field of automatic or semi-automatic dispensing machines for paper wipes of the hand-wipe, toilet paper, general-purpose wipe and similar types.

BACKGROUND OF THE INVENTION

There are already many dispensing machines for paper wipes, especially those developed by the Applicant, which ensure dispensing either in automatic mode after the user simply pulls the paper or in semi-automatic mode requiring the use of an operating lever. These dispensing machines are operationally reliable but it is not always very easy to implement selection of the operating mode and this requires an extremely large number of parts. Current semi-automatic machines often require repeated intervention or manipulation of the operating lever in order to make the strip of paper emerge from the machine.

SUMMARY OF THE INVENTION

The object sought after according to the invention is therefore to design a machine that is very simple and which can be easily manipulated, after visualisation of the automatic or semi-automatic modes.

Another object sought after is to design a machine containing a minimum of parts and components.

Another object sought after is to obtain, in semi-automatic dispensing mode, emergence of the strip of paper out of the machine by a single operation performed by the operator.

These objects and others will become apparent from the rest of the description.

According to a first aspect, an automatic or semi-automatic dispensing machine for wipe material includes a housing that accommodates a hinged cover. The housing has walls or lateral end shields between which a drum associated with a cutting device is positioned. An off-center lever is mounted at one end of a drum shaft and accommodates a first elastic return means used to start it. The surface of the drum opposite that accommodating the off-center lever being designed with an axially located operating button, is distinctive in that it includes a device for selecting the operating mode, whether an automatic or semi-automatic mode. The device further includes a first sub-assembly forming a double lever with opposite legs mounted so that a middle part of the lever pivots freely relative to a fixed point on one of the end shields of the machine housing. The ends of the double lever are devised so that they are functional depending on the mode (automatic or semiautomatic) in which the machine is used. A handle of the selector device is positioned and hinged around the hinge pin of the double lever such that the handle pivots between two end positions in opposition to a second elastic return means. Depending on its location, the double lever is positioned relative to the drum and ensures operation of the device in either the automatic version or semi-automatic version.

These aspects and others will be apparent from the following description.

BRIEF DESCRIPTION OF THE DRAWING

In order to define the object of the invention shown merely by way of example, reference is made to the accompanying Figures in which.

DETAILED DESCRIPTION OF THE INVENTION

Figure 1:
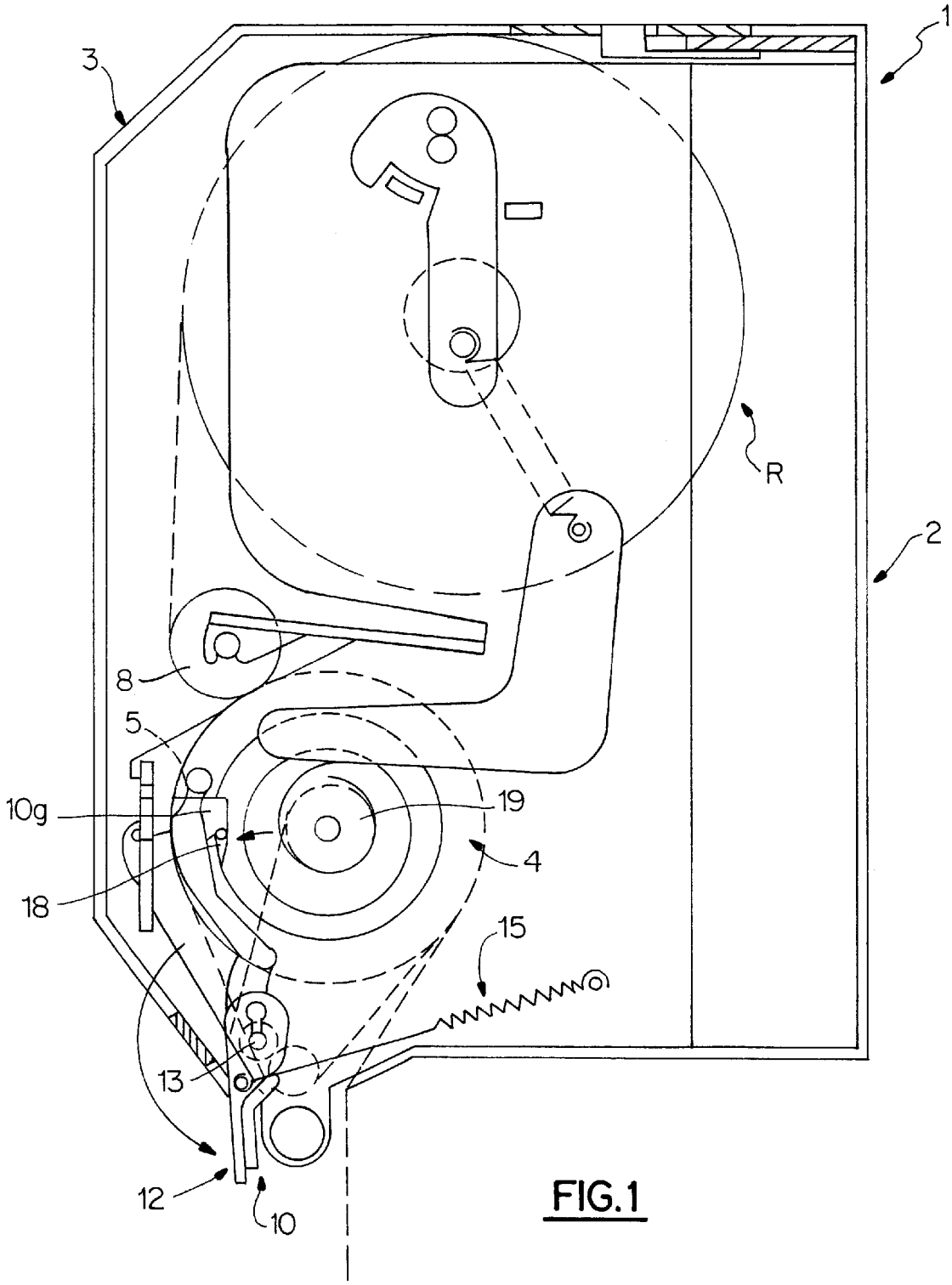
FIG. 1 is a profile view of the machine in its automatic operating mode highlighting the various components of the selector device.

In order that the object of the invention may be more readily understood, it is now described by way of example, reference being made to the Figures in the drawings.

The paper-wipe dispensing machine is referred to in its entirety as (1). It is used for the automatic or semi-automatic dispensing of strips of paper for use as hand-wipes, general-purpose wipes or toilet paper. These strips may be presented flat, folded, or unfolded depending on the techniques and means described in numerous patents that have been developed by the Applicant.

Before describing the characteristics of the automatic or semi-automatic mode selector device, it is appropriate to first restate the known general configuration of this type of machine. The selector device which is the subject of the present invention is not strictly speaking confined to the layout of the known components which will be described below by way of examples.

The machine comprises a housing (2) made of any material on which a cover (3) is hinge-mounted on the front. The housing has lateral walls or end shields capable of accommodating and allowing transverse positioning of a drum (4) associated with a built-in cutting device (5). This drum with the cutting device is described, in particular, in French Patent No. 2.332.215 incorporated herein by reference in its entirety. In particular, it uses, on one of the transverse sides of the machine and to ensure rotation and starting of the drum, an off-centre lever (6) mounted on the shaft of the drum capable of accommodating an elastic return means (7) used to start it in order to ensure fast, clean cutting of the paper.

Above the drum there is, still in accordance with the prior art, a pressure component (8) that pushes against the drum, the strip of paper being inserted between its two components from a reel or roll of material (R) placed between the upper end shields of the housing. The roll and pressure component are secured in any appropriate manner on the above-mentioned end shields, by clicking them in for example.

The face of the drum opposite that which accommodates the off-centre lever, is designed with an operating button (9) located axially and used to initiate operation of the initial part of the strip.

Figure 3:
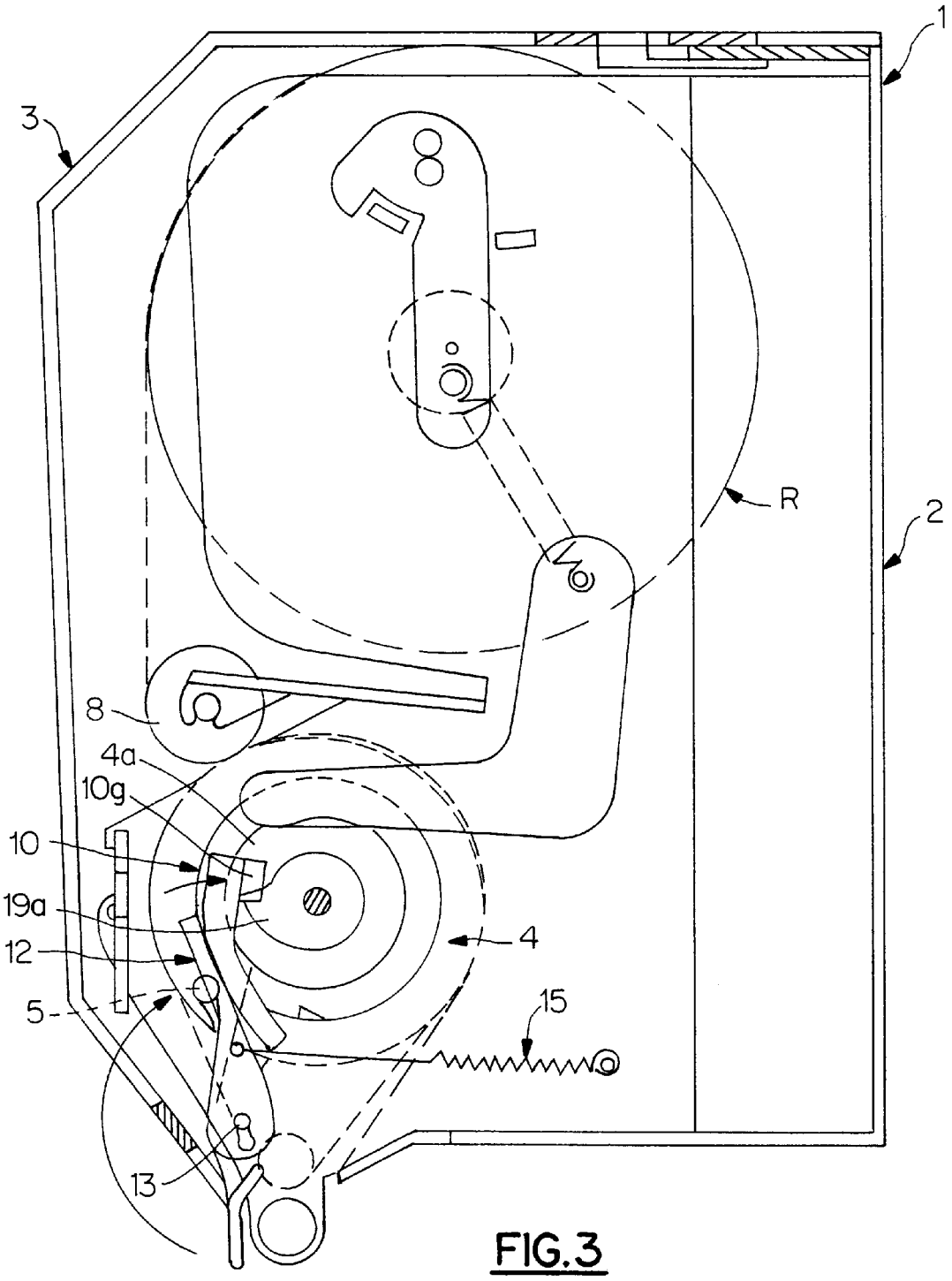
FIG. 3 is a view similar to the profile view of the machine in FIG. 1 in its semi-automatic version.

It is very briefly recalled that this type of device, as depicted in FIGS. 1 and 3 of the present application, generally includes a molded housing (2) containing a take-off reel (R) of paper material, a material cutting-blade (5) pivotally mounted to a support drum (4), and a tensioning device (8). As illustrated by a dotted line in FIGS. 1 and 3, a roll of the paper material is mounted on the take-off reel (R). The installer of the paper material manually extends a portion of the material from the take-off reel (R) and feeds the portioned material between the drum (4) and the tensioning device (8) which rests against the drum (4). The extended material traverses the circumference of the drum (4) and extends through a slot provided in the bottom of the housing. When the user applies tension to the paper material either by pulling on the paper material protruding from the bottom slot or by engaging the automatic elastic means, the drum (4), with its roughened surface, is driven in rotation. The elastic return means (7) attached to the drum is adapted to store energy during the initial rotation of the drum (4). The drum (4) rotates until a dead point is reached whereafter the elastic return means (7) releases its energy to vigorously drive the drum (4) in the same paper unwinding direction, causing a predetermined portion of the paper material to extend through the bottom slot of the apparatus.

The cutting device has been made the subject of previous patents of Applicant; for example, U.S. Pat. No. 4,122,738. Generally, the cutting device (5) consists of a toothed metal blade. The drum (4) includes a longitudinal slot and the cutting device (5) is pivotally mounted in the slot of the drum (4) and carries a follower which cooperates with a fixed cam such that the cutting device is retracted into the drum in an inoperative position and projects from the slot in the drum in the operative position to produce a cut across the entire width of the paper material while the latter is maintained in tension on both sides of the cutting device. When the deadpoint is reached, the follower causes the cutting device to pivot which produces exit of the blade through the slot in the drum (4) making it describe an arc of a circle spaced from the drum (4) (under the rotation effect of the drum). The tension on paper material resulting from the user's pulling combined with the pressure of the take-off reel (R) and tensioning device (8) on the drum (4), causes the teeth of the blade to penetrate the taut paper and effect a clean instantaneous cut.

These general components having been restated, the selector device in accordance with the invention, and which makes it possible to convert the machine to automatic or semi-automatic operation quickly, will now be explained.

For this purpose and according to the invention, the operating mode selector device of the automatic version or semi-automatic version of the machine comprises a first sub-assembly (10) forming a double lever with opposite legs (10*a*–10*b*), its middle part (10*c*) having an opening (10*d*) or hole capable of engaging with a fixed point of the peg type (11) of matching shape located on the front end of the end shield facing the housing. This double lever comprises a first profiled leg (10*a*) facing towards the outside of the machine and forming a push surface (10*e*) for positioning the user's thumb. Advantageously, a legend or marking is indicated on the above-mentioned push surface—in the example shown, the word "PUSH". The other leg (10*b*) of this double lever is devised so that its end is in the shape of a double bent hook (10*f*) one end (10*g*) of which is curved in order to fit into a cylindrical opening (4*a*) formed on the end shield (4*b*) facing the drum. This double lever is mounted so that it pivots freely around its peg-shaft.

The selector device comprises a second component defined by a handle (12) which is positioned and centred relative to the hinge pin (11) of the double lever. For this purpose, said handle has a flank (12*a*) made with an oblong opening (12b) capable of allowing it to engage with and travel around a protruding pin (13) devised so that it projects beyond the peg (11). The flank of said handle has a finger (14) used to fix a return means (15) of the spring type, the first end (15*a*) of which is attached to the finger and the other end (15*b*) of which is attached to a protruding point (16) formed on the end shield of the housing. The handle also has a tab (12*c*) of almost identical profile to the push surface of double lever (10) so that said tab is capable of moving into a position directly above the push surface. The word "STOP" for example is marked on the lower surface of the tab and an arrow symbol, for example, is marked on its upper surface. Thus, when the handle rests against the double lever the word "PUSH" on the tab is hidden and only the upper surface of the handle with the arrow symbol is visible.

Figures 5, 10:
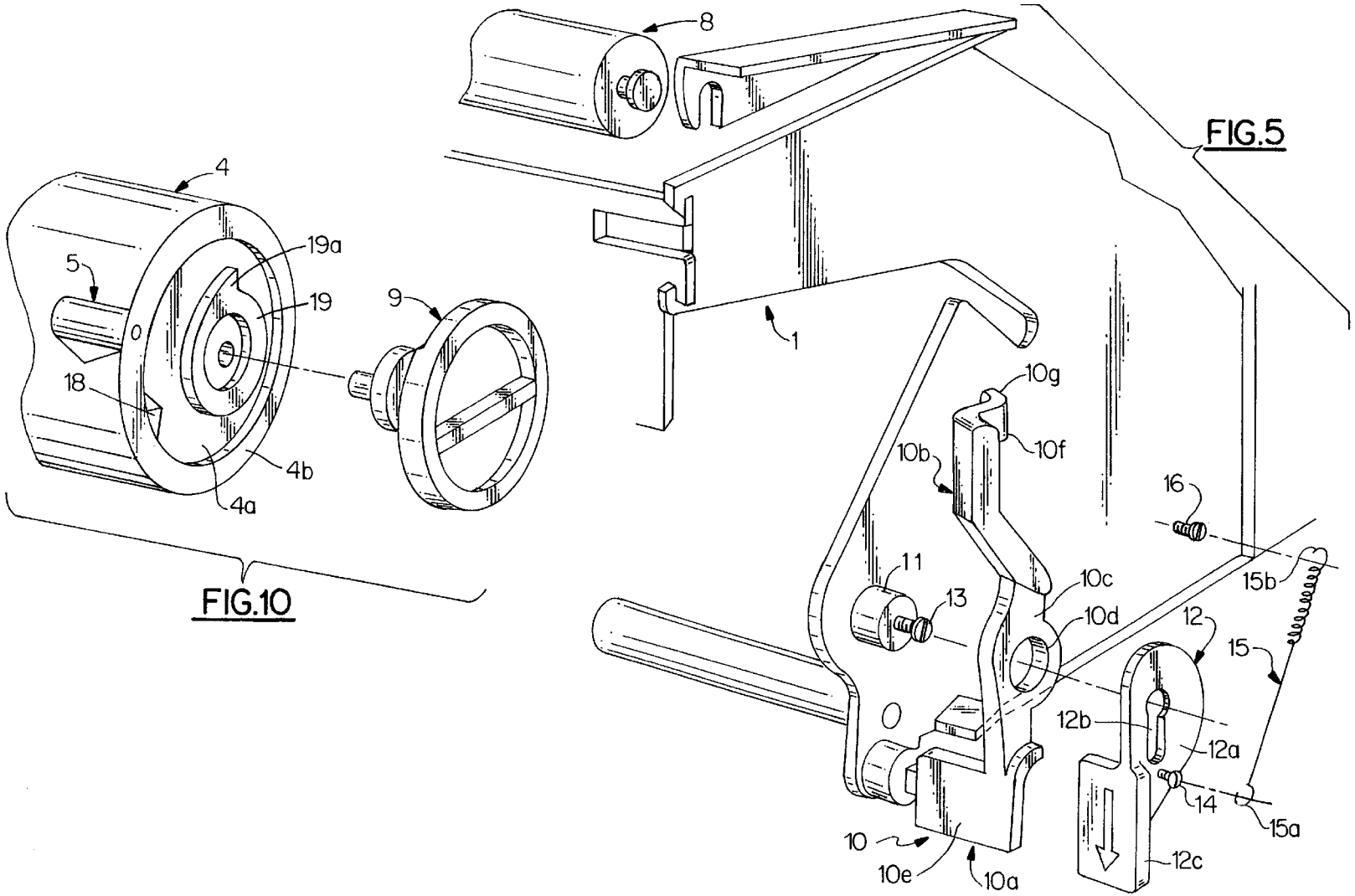
FIG. 5 is an enlarged scale partial view before assembly of the selector device according to the invention.
FIG. 10 is an enlarged scale partial view showing the drum of the dispensing machine devised with means that contribute to the operation of the machine.
Figure 6:
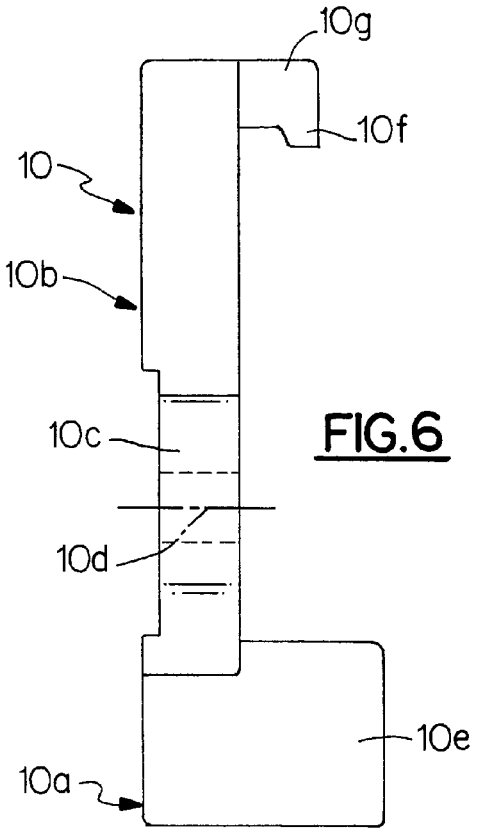
FIG. 6 is a partial plan view according to a rear view of a first sub-assembly of the selector device.
Figure 7:
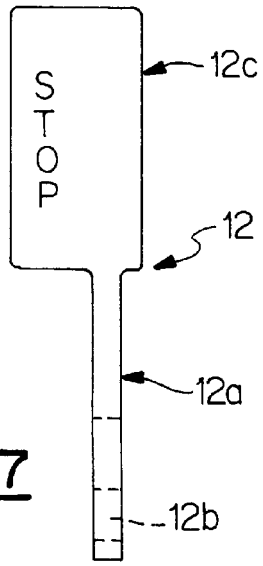
FIG. 7 is a partial plan view according to a rear view of a second sub-assembly of the selector device.
Figure 8:
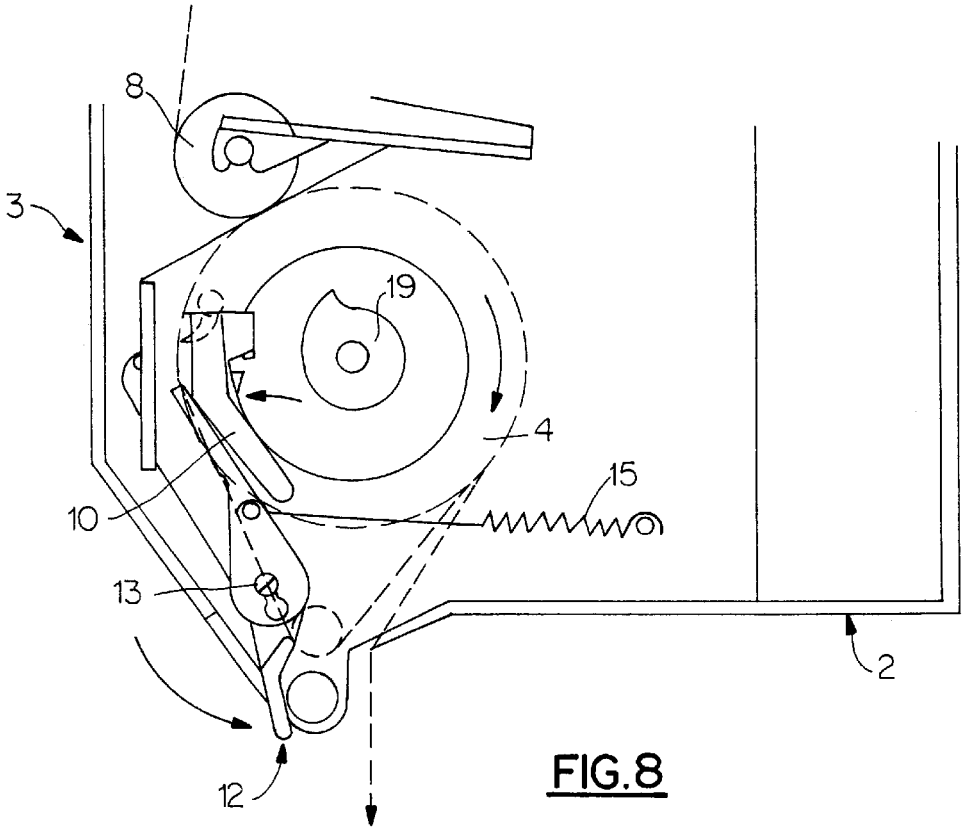
FIG. 8 is a view of the dispensing of paper in the semi-automatic version after a single manual command given by the operator to make the paper emerge.
Figure 9:
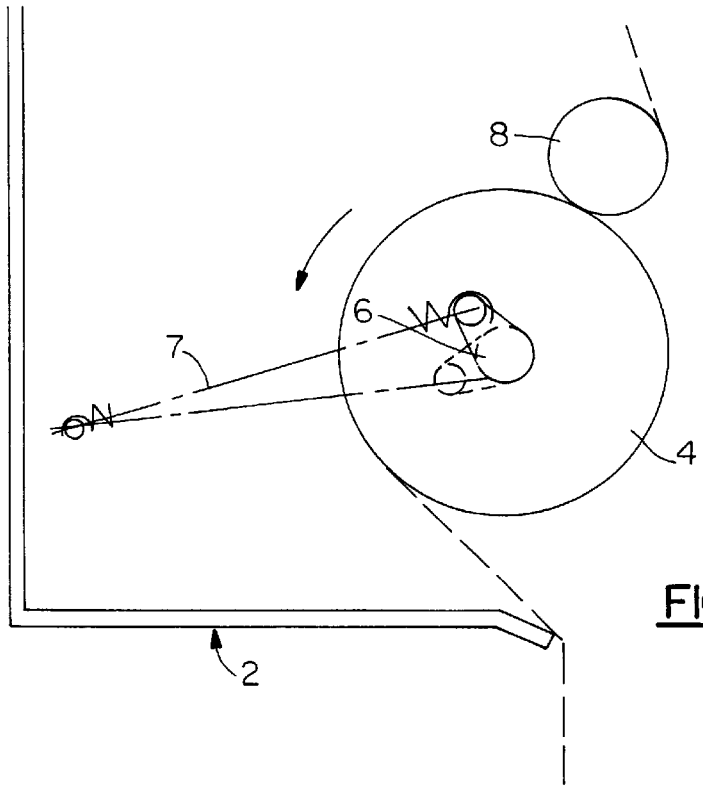
FIG. 9 is an enlarged scale view of the opposite part of the dispensing machine highlighting the means used to eject the strip of paper after actuating the operating lever in semi-automatic selection mode.

As indicated above, the drum (4) is devised with an internal circular opening (4*a*) on the same side as the operating button and facing the double lever. As shown in FIG. 10, the outer periphery of the cavity has a projection (18) forming a non-return limit stop when the dispensing machine operates in automatic mode. In addition and around the shaft of the drum, there is a profiled cam (19) having a beak shape (19*a*) that constitutes a non-return limit stop when the machine operates in semi-automatic mode.

The operation of the machine in both versions where the selector device is in the automatic dispensing position and then in the semi-automatic dispensing position is now described, reference being made to the drawings.

Figure 2:
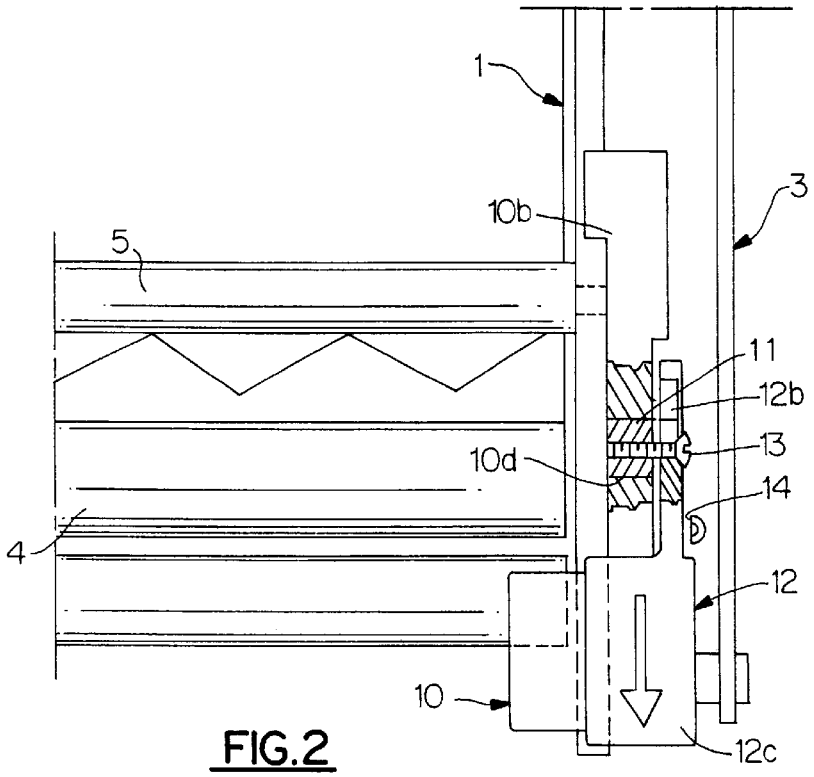
FIG. 2 is a partial side view in accordance with FIG. 1 showing the position of the selector device in the automatic dispensing version.
Figure 4:
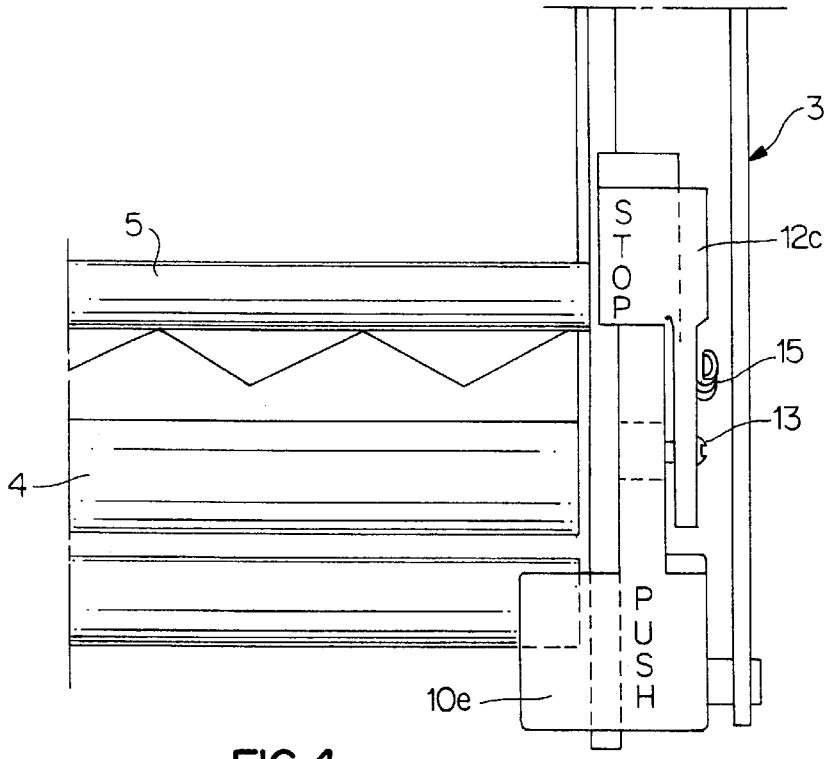
FIG. 4 is a view similar to FIG. 2 along arrow B in FIG. 3 in the semi-automatic version.

In FIGS. 1 and 2, the dispensing machine is in automatic mode. In this case handle (12) is positioned immediately above the small tab of the double lever. It is secured in position, as is the double lever, by the return force of the elastic means (15) directly associated with the handle. Due to this force, the hook part of the double lever is pulled towards the front of the machine so that it follows the external inside profile of the cylindrical cavity of the drum. The non-return limit stop prevents the drum from rotating in the opposite direction. During this use, the off-centre lever and its return spring located on the other side of the drum operates normally and, after dispensing a length of paper strip, the spring associated with the off-centre lever for starting the drum returns to its initial slack position.

When the operator wants to set the machine to semi-automatic mode, he/she actuates handle (12). The handle pivots 180° relative to the hinge pin associated with the rotation peg on the double lever. This therefore reveals the word "PUSH" marked on the push surface of leg (10*a*) of the double lever. This then causes extension of spring (15) associated with the handle and, if the latter moves beyond the dead point corresponding to maximum extension of the spring, the handle is then pulled back against the second leg of the double lever and is secured by the spring-back effect of the spring in question thereby revealing the word "STOP". Due to the pressure force of above-mentioned spring, the double lever is, in its turn, pivoted by several degrees into the position shown in FIG. 3. In this case the hook part of the double lever comes into contact and presses against the cam in the cavity made in the drum. This semi-automatic positioning will cause partial displacement of the hook part of the double lever along a trajectory of rotation of less than 360° due to the limit-stopping effect created by the special-purpose profile of the cam. The drum is therefore locked in position and the strip of paper does not emerge from the machine. The spring associated with the off-centre lever still retains its residual tension. In order to ensure ejection of the paper, the operator then presses on the double lever on the corresponding pressure area, thereby exerting a thrust force that exceeds that of the spring associated with the handle. The hook part of the double lever therefore moves away releasing itself from the cam and its limit stop and therefore releasing the drum. The residual tension of the spring associated with the off-centre lever in turn causes a spring-back force which enables the drum of the machine to rotate several degrees over an angular sector that is sufficient to make the strip of paper emerge so that it can be pulled by the user.

Spring (15) associated with handle (12) ensures, through its spring-back effect, jamming and locking in position of the handle and double lever.

The selector device is therefore extremely simple and does not require any special mechanical means. It is easy for an operator to manipulate it. This is facilitated by marking several visual legends that are simple to remember. The device can be installed quickly and the shape of the parts is simple to produce.

What is claimed is:

1. A paper dispensing machine capable of an automatic and a semi-automatic operation mode, said paper dispensing machine comprising:

a housing accommodating a hinged cover;

a drum positioned between opposing end shields of said housing, said drum having a drum shaft;

a cutting device associated with said drum;

an off-center lever mounted at one end of said drum shaft and accommodating a first elastic return component used to actuate said off-center lever, the end of the drum shaft opposite that accommodating said off-center lever including an axially mounted operating button; and a selector device for selecting the operating mode of the machine, said selector device including a first sub-assembly forming a double lever with opposite legs mounted such that a middle part freely pivots relative to a fixed point on one of said opposing end shields of the housing, and defining a pivot axis thereof, the ends of the double lever being functional depending on the mode in which the machine is used, said selector device further including a handle positioned and pivotally mounted about the pivot axis of the double lever, said handle being pivotally mounted between two end positions counter to a second elastic return component enabling, the double lever to be positioned relative to the drum and allowing the selector device to selectively enable between automatic and semi-automatic modes, said double lever including a first profiled leg facing the exterior of the machine and the handle having a tab of identical profile to the push surface of the double lever, said first profiled leg forming a push surface for positioning a user's thumb, said push surface being marked with the word "PUSH", whereas respective upper and lower surfaces of the tab of the handle are marked respectively with an arrow and the word "STOP".

2. A paper dispensing machine as recited in claim 1, wherein said double lever includes a second leg, one end of the second leg having a double bent hook shape having one curved end which fits into a cylindrical opening formed on an end shield of the drum.

3. A paper dispensing machine as recited in claim 2, wherein the middle part of the double lever includes an opening that freely engages with a fixed peg located on the end shield facing the housing.

4. A paper dispensing machine as recited in claim 3, wherein the handle is positioned and centered on a hinge pin of the double lever, said handle further having a flank made with an oblong opening enabling engagement with and travel around a protruding pin that projects beyond the fixed peg.

5. A paper dispensing machine as recited in claim 4, wherein the flank of the handle includes a finger used to fix said second elastic return component, said second elastic return component including a spring having a first end attached to the finger and an opposite end which is attached to a protruding point formed on an end shield of the housing.

6. A paper dispensing machine as recited in claim 5, wherein the drum includes an internal circular opening formed on the same side thereof as the operating button and facing the double lever, said internal circular opening including a projection on the outer periphery of the opening forming a non-return limit stop in order to obtain automatic operation of the machine and an axial cam having a profile for enabling semi-automatic operation of the machine.

7. A paper dispensing machine as recited in claim 6, in which during semi-automatic operation of the machine, the end of the bent part of the double lever is in contact with the profile of the axial cam after partial rotation of the drum corresponding to no ejection of the strip of paper from the machine, thereby leaving a residual release force in the first elastic return component which is associated with the off-center lever, and in that actuating the push surface of the double lever releases said drum at the end of its rotation due to the spring-back effect of the first elastic return component associated with the off-center lever in order to make a strip of paper emerge so that it can be grasped.

8. A paper dispensing machine as recited in claim 7, wherein the interconnection of the second elastic return component with said handle ensures a spring-back effect, if said second elastic return component is overextended, said spring-back effect causing the handle and the double lever to be secured in a locked position.

9. A paper dispensing machine as recited in claim 8, in which when in the automatic paper dispensing version, the double lever is in a position where its curved end is in contact with the outer periphery of the circular opening made underneath the end shield of the drum and the tab of the handle presses against the push surface of the double lever due to the tension and spring-back action of said second elastic return component;

and in which, in the semi-automatic dispensing position, the double lever is in a position where it is tilted towards the rear with one leg in contact with said axial cam and the handle presses against the opposing leg of the double lever and is secured in position by the tension/spring-back effect of said second elastic return component with the push surface of the double lever being free.

* * * * *